US010010904B2

(12) United States Patent
Palushaj

(10) Patent No.: US 10,010,904 B2
(45) Date of Patent: Jul. 3, 2018

(54) APPLICATOR FOR APPLYING A COATING MATERIAL TO A SUBSTRATE

(71) Applicant: Epoxi Tech, Inc., Madison Heights, MI (US)

(72) Inventor: Simon Palushaj, Washington, MI (US)

(73) Assignee: Epoxi Tech, Inc., Madison Heights, MI (US)

( * ) Notice: Subject to any disclaimer, the term of this patent is extended or adjusted under 35 U.S.C. 154(b) by 860 days.

(21) Appl. No.: 14/371,902

(22) PCT Filed: Dec. 22, 2012

(86) PCT No.: PCT/US2012/071531

§ 371 (c)(1),
(2) Date: Jul. 11, 2014

(87) PCT Pub. No.: WO2013/096933

PCT Pub. Date: Jun. 27, 2013

(65) Prior Publication Data

US 2015/0020328 A1 Jan. 22, 2015

Related U.S. Application Data

(60) Provisional application No. 61/579,363, filed on Dec. 22, 2011.

(51) Int. Cl.
*B05C 17/02* (2006.01)

(52) U.S. Cl.
CPC ..... *B05C 17/0207* (2013.01)

(58) Field of Classification Search
CPC ..... B05C 17/0207
See application file for complete search history.

(56) References Cited

U.S. PATENT DOCUMENTS

| | | | | | |
|---|---|---|---|---|---|
| 2,866,995 | A * | 1/1959 | Evensen | B05C 17/0207 | 15/181 |
| 2,957,412 | A * | 10/1960 | Rainey | B05C 17/0207 | 101/376 |
| 3,433,693 | A * | 3/1969 | Evensen | B05C 17/0207 | 156/242 |
| 5,133,117 | A * | 7/1992 | Lomasney | B05C 17/021 | 15/104.94 |
| 5,693,141 | A * | 12/1997 | Tramont | B05C 17/0207 | 118/211 |
| 7,871,362 | B2 * | 1/2011 | Kohlruss | B01D 39/08 | 29/895 |
| 2010/0251500 | A1 * | 10/2010 | Lin | B05C 17/0207 | 15/230.11 |
| 2011/0099741 | A1 * | 5/2011 | Gallardo | B05C 17/0207 | 15/230.11 |

* cited by examiner

*Primary Examiner* — Randall Chin
(74) *Attorney, Agent, or Firm* — Bejin Bieneman PLC

(57) ABSTRACT

An exemplary coating applicator is provided for evenly applying a material having an aggregate to a substrate. The exemplary applicator provides for a generally even distribution of the material and the aggregate the coating material to the surface such as a wall or a floor where it is desirable to have a finished, textured surface and a material having an evenly distributed aggregate.

14 Claims, 5 Drawing Sheets

APPLICATOR FOR APPLYING A COATING MATERIAL TO A SUBSTRATE

CROSS REFERENCE TO RELATED APPLICATION

This application claims the benefit of and priority to U.S. Provisional Patent Application No. 61/579,363, filed Dec. 22, 2011, in the name of Simon Palushaj and entitled APPLICATOR FOR APPLYING A COATING MATERIAL TO A SUBSTRATE, the entire contents of which are incorporated herein for all purposes.

FIELD

The present disclosure generally relates to an applicator for applying material to a substrate. More particularly, the present disclosure relates to an improved applicator and method that will evenly roll on a coating material having aggregate particles in the coating material for disbursement of same on a substrate surface such as a floor of a factory.

BACKGROUND

It is generally known to provide a paint roller on the end of a handle for use in applying paint to a surface that needs to be treated. Depending on what is desired for the finished surface and its intended use and/or location, the finished surface could be a smooth flat surface or a heavily textured surface. For example, sometimes it may be desirable for the ceilings and floors to have a more highly textured surface that provides a visual appearance that contains relatively greater depth and texture. To acquire a relatively greater depth and texture finish, traditionally a paint roller may be used that includes a relatively thinker nap which allows for the applied material, such as paint, to develop deeper contrasts and surface depth with desirable configurations. It is also generally known that it is possible to apply several coatings to obtain the desired relatively greater depth and texture finish. This technique, however, is generally used with paint that has a consistent and smooth texture and no suspended aggregate particles. In certain applications where a rough or heavily textured surface is desired, it is the experience of the inventor that traditional tools and methods simply will not result in a desired relatively greater depth and texture finish.

It may be desirable at times to provide a relatively thick textured surface on the floor of a facility, such as a manufacturing plant or similar operation, to improve the performance of the operation. This may be done by grinding or chemically etching the floor by mechanical means which results in a textured surface that people can walk on in a safe manor. However, this technique requires costly machinery and processes to be employed which can also be dirty and emit maybe even caustic fumes depending upon the finish that is being removed. It is also generally known to apply a coating material on a surface by first using a roller and applying a smooth coating material to the surface. While the coating material is still wet, aggregate is then located, by throwing, on the wet surface which allows the aggregate to be highly inconsistently mixed in and hardened as the coating material cures. The aggregate then becomes affixed to the substrate in the manor in which it was originally disbursed. A significant limitation this technique is that the aggregate may not be evenly disbursed on the floor which could result in some spaces not being treated with an aggregate. This process could result in areas to be exposed on the floor which do not have the desired amount of traction or consistent visual appearance.

Given the noted and other limitations of the generally known systems, there long remains a significant need to provide an improved process and/or apparatus that permits the application of a coating material that contains an aggregate material which can be evenly disbursed on a substrate, such as a wall or floor, and that will provide a relatively greater depth and texture finish. There further long remains a significant need to provide such an improved process and/or apparatus that will permit the application of such a coating material containing evenly disbursed aggregate wherein the material may be allowed to cure without further effort and still obtain an improved surface such as a floor having greater traction. There further long remains a significant need to provide such an apparatus and method that effectively minimizes costs and work efforts associated with applying the coating material to surfaces.

SUMMARY

In one particular aspect of the present disclosure there is provided an applicator for applying a coating material. The applicator includes a backing member and a liquid absorbing material attached to the backing member, the liquid absorbing material having a first side arranged adjacent the backing member and an opposite second side. The applicator further includes a support member engaging the liquid absorbing material, at least a portion of the support member arranged between the backing member and the second side of the liquid absorbing material.

In another aspect of the present disclosure there is provided an applicator for applying a coating material. The applicator includes a generally cylindrical backing member with an exterior surface. A support member extends outward from the exterior surface of the backing member. A liquid absorbing member is attached to the exterior surface of the backing member. A handle assembly can be provided with the applicator which provides a unique apparatus for applying a coating material with aggregate to a surface. It will be appreciated that other aspects of the present invention are contemplated.

DETAILED DESCRIPTION

Figure 1:
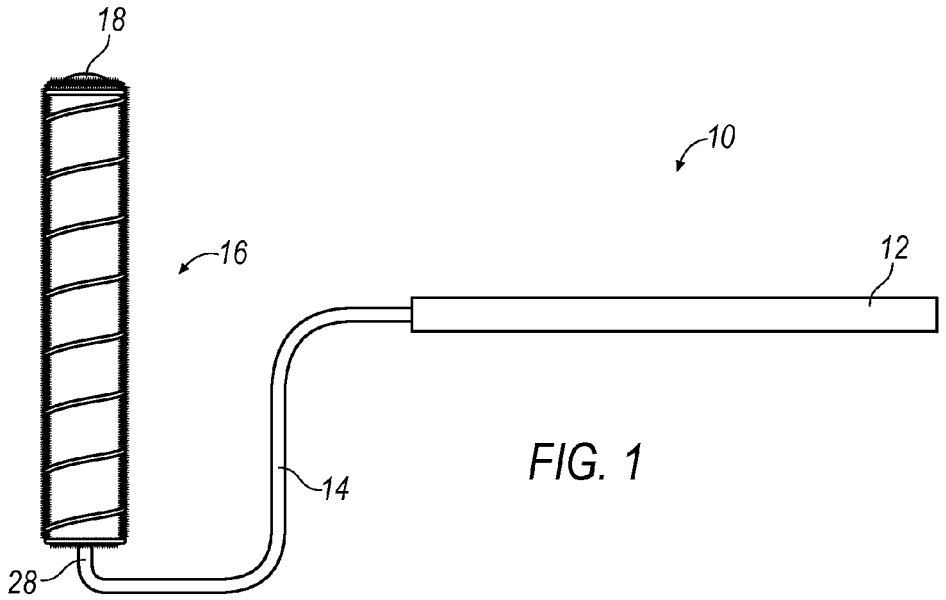
FIG. 1 illustrates one aspect of the present invention where an exemplary roller assembly for applying a coating material to a substrate is depicted.

Referring now to the discussion that follows and generally to the figures of the drawings, illustrative approaches to the disclosed apparatus and methods are described in detail. Although the drawings represent several alternative exemplary embodiments as possible solutions, the drawings are not necessarily to scale and certain features may be exaggerated, removed, or partially sectioned to better illustrate and explain the present disclosure. Further, the exemplary embodiments and descriptions set forth herein are not intended to be exhaustive, otherwise limit, or restrict the claims to the precise forms and configurations shown in the drawings and disclosed in this detailed description.

FIG. 1 illustrates an exemplary roller assembly 10 for applying to a substrate a coating material having aggregate. The roller assembly 10 includes a handle 12, a bent portion 14 and an applicator 16. The applicator 16 may have an end cap 18 for preventing material from entering an internal chamber of the applicator 16. It will be appreciated that the handle 12 and bent portion 14 can be replaced with different configurations and be used with the novel applicator 16.

Figure 2:
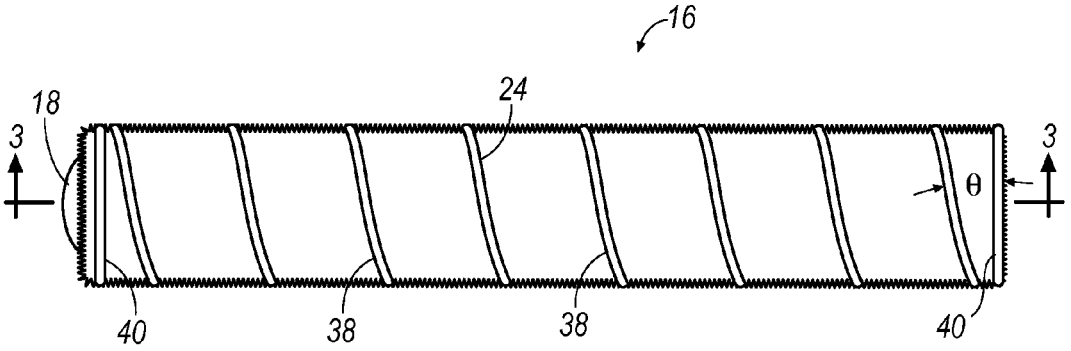
FIG. 2 illustrates an exemplary applicator that may be employed with the roller assembly of FIG. 1.
Figure 3:
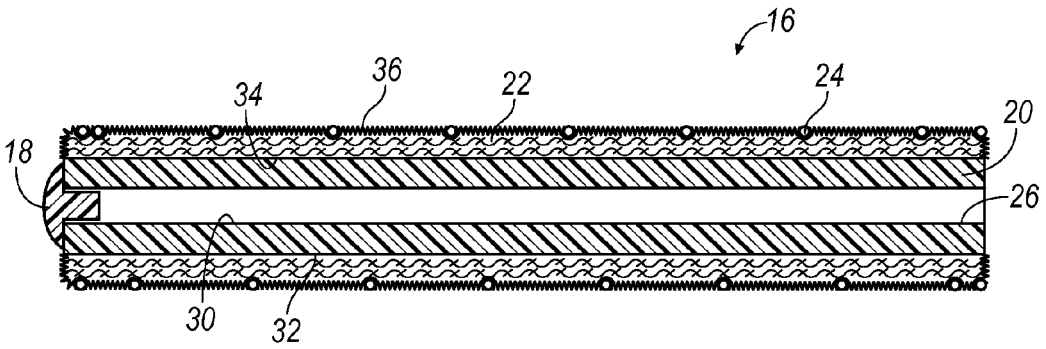
FIG. 3 illustrates a cross-sectional view of the applicator, taken from section 3-3 of FIG. 2.

FIGS. 2 and 3 illustrate a front view of the applicator 16. FIG. 3 illustrates a section view taken along line 3-3 as seen in FIG. 2. The applicator 16 includes a backing member 20, a liquid absorbing member 22 and a support member 24 that extends peripherally and around the circumference of the liquid absorbing member 22. The backing member 20 has an axially extending central cavity 26 that is operable to receive an end 28 of the bent portion 14. The backing member 20 is sufficiently rigid to withstand the pressures that are associated with applying material to surfaces. The backing member has an interior surface 30 and an exterior surface 32.

The liquid absorbing member 22 has an interior first surface 34 and an outer second surface 36 which serves the purpose of delivering liquid material such as paint to the surface of a substrate. The liquid absorbing member 22 is made of conventional material and is a generally resilient material that permits the absorption and then delivery of a liquid to a surface to be treated. The liquid absorbing member 22 can be affixed to the backing member 20 by various methods as is known in the art. It will be important to provide sufficient friction between the backing member 20 and the liquid absorbing member 22 so as to assure the liquid absorbing member 22 remains affixed to the backing member 20.

A support member 24 is wrapped around the outer surface 36 of a liquid absorbing member 22. The outer surface 36 is generally comprised of a textured surface that would be desirable to be placed on a substrate, such as a concrete floor in a building. As is shown in FIG. 3, the support member 24 can be a helically shaped spring that is wrapped around the outer surface 36 of the liquid absorbing member 22. It is preferred to have a sufficiently rigid support member 24 that does not collapse upon usual pressure being applied so as to afford sufficient rigidity to the applicator 16 during its operation. The support member 24 has a plurality of offset helical members 38 that extend axially from an end of the applicator 16 to its distal end. It is preferred that the offset helical member 38 be angled and offset from the vertical end portion 40. The angle delta ø between the vertical end portion 40 and one of the offset helical members 38 is approximately 30 degrees but it will be appreciated that other greater or lesser angles may be employed. For example, the angle delta ø may alternatively be between 20 and 40 degrees. An advantage of providing the offset helical member 38 is that the tracks that they create during operation are covered up by the outer surface 36 applying the liquid material to the substrate surface.

Figure 4:
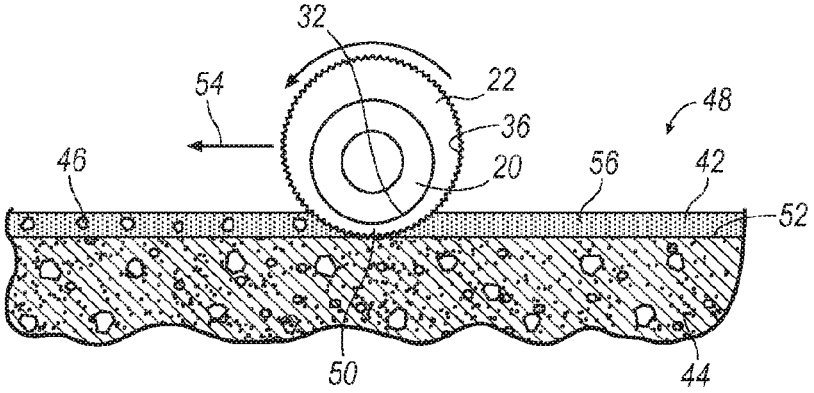
PRIOR ART FIG. 4
FIG. 4 illustrates a conventional roller applying a coating to a substrate.

With reference to FIG. 4, a conventional paint roller 48 having a backing member 20 and absorbing member 22 is depicted. This conventional roller 48 is shown applying liquid coating 42 to a substrate such as a concrete floor 44. Aggregate 46 may be dispersed within the liquid coating 42. Using a conventional roller 48 in this type of situation results in the liquid absorbing member 22 compressing 50 at the area where it engages the substrate 44 which decreases the distance or gap between the exterior surface 32 of the backing member 40 and the upper surface 52 of the substrate 44. The area of compression 50 can vary based upon how hard a person pushes down on the roller assembly 48 which results in variances as to the thickness of the liquid coating 42, as well as dispersion of the aggregate 46. If a worker pushes too hard on the roller 48, then it results in pushing the aggregate 46 forward 54 which causes the aggregate 46 to build up because it is not permitted to pass underneath the outer surface 36 of the liquid absorbing member 22. This action is undesirable because it results in areas 56 of the floor without any aggregate 46, or perhaps a build up or clumps of aggregate 46 if they pass in mass under the member 22.

Figure 5:
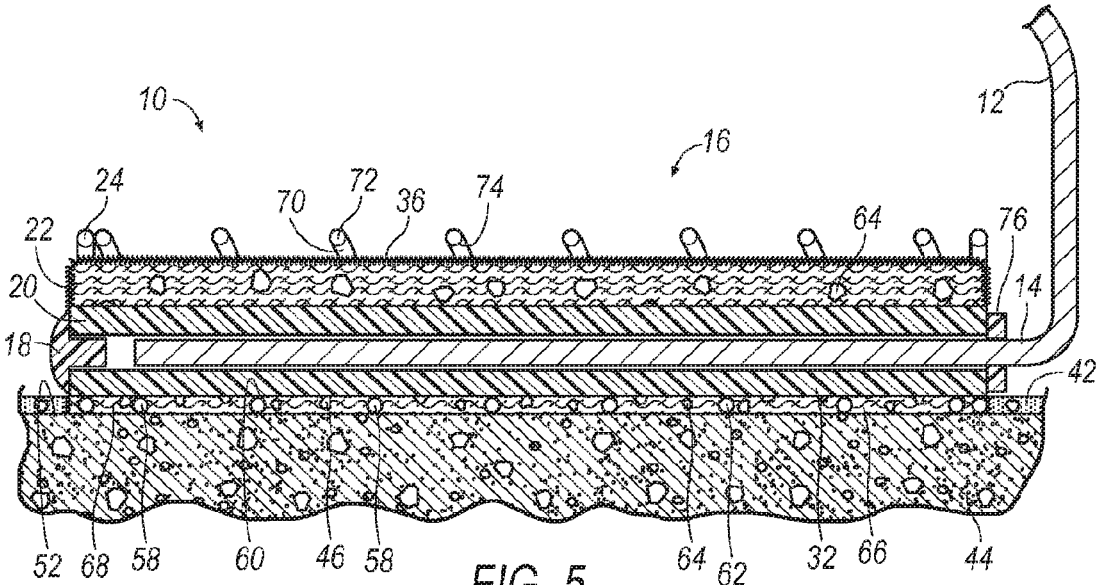
FIG. 5 is a cross-sectional view of the applicator of FIG. 3, shown applying a coating material to a substrate.

With particular reference now to FIG. 5, the novel roller assembly 10 is depicted during its operational state where pressure is being applied on the assembly 10 and liquid coating 42 is being applied to the substrate 44. In this working example, the support member 24 has lower portions 58 with an outer diameter which rides along the upper surface 52 of the concrete floor 44. The opposite side 60 of the lower portion 58 of the support member 24 butts up against the exterior surface 32 of the backing member 20. The diameter of the support member 24 is approximately ⅛" but it will be appreciated that other dimensions could be employed. It is important, however, that the diameter 62 of the support member 24 be sufficiently larger than the diameter 64 of the aggregate 46 particles that are disbursed. This assures that the aggregate 46 fits within the clearance space 66 that is defined by the exterior surface 32 of the backing member 20 and the upper surface 52 of the substrate 44. The diameter 62 of the support member 24 acts as a guide to help offset the outer surface 36 of the liquid absorbing member 22 a sufficient distance away from the concrete floor 44. It will be appreciated that if the consumer would like to apply a larger aggregate 46 to the floor 44, then the diameter 62 of the support member 24 can be modified accordingly to be slightly larger than the diameter of the newly preferred aggregate 46.

By providing the diameter 62 of the support member 24 so that it is sufficiently larger than the diameter 64 of the aggregate 46, the problem depicted in FIG. 4 is overcome. In particular, as the worker advances the roller assembly 10 forward, the aggregate 46 is allowed to be evenly dispersed on the upper surface 52 of the floor 44. When this occurs, the liquid absorbing member 22 compresses as is shown in FIG. 5, but it does not over-compress because it is impinged or stopped by the outside diameter 62 of the support member 24. When this occurs, a gap 70 occurs between an upper portion 72 of the support member 24 and the outer surface 36 of the liquid absorbing member 22. The liquid absorbing member 22 is operable to float within the physical parameters of the support member 24 a distance which in part is defined by an inside diameter 74 of the support member 24. A cover 76 abuts against the backing member 20 and prevents aggregate 46 from entering the cavity of the backing member 20.

Figure 6:
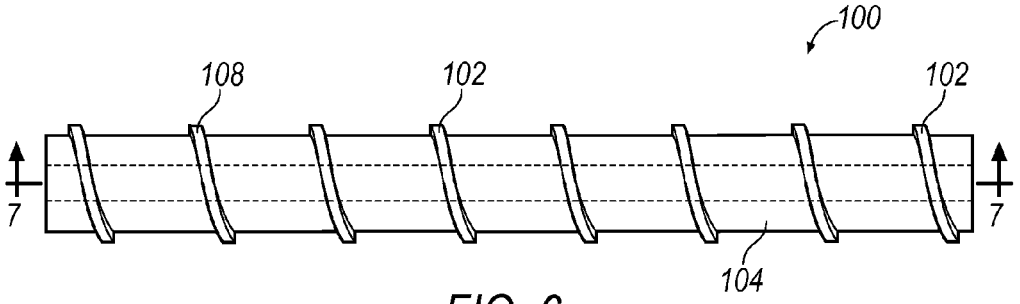
FIG. 6 illustrates an alternative backing member that may be employed with the roller assembly that is shown in FIG. 1.
Figure 7:
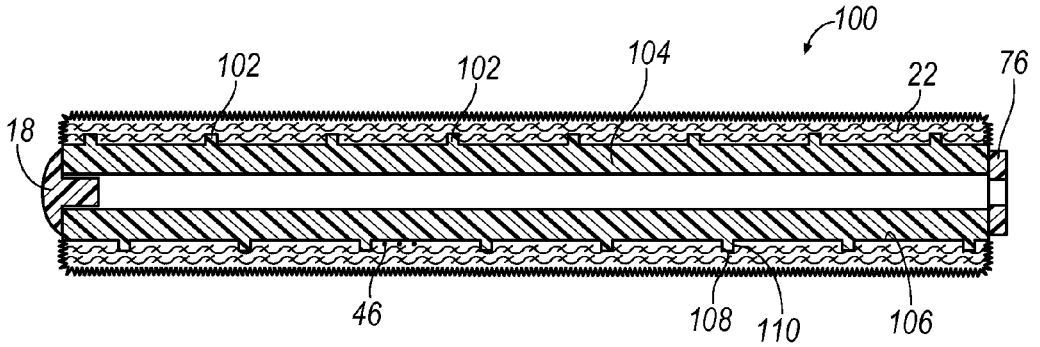
FIG. 7 is a cross-sectional view of the FIG. 6 backing member, with a liquid absorbing member installed.

FIGS. 6 and 7 illustrate a portion of an alternative exemplary embodiment of the roller assembly 10 according to the present disclosure including an improved backing member 100 is disclosed. The backing member 100 can be utilized with the liquid absorbing member 22 that was previously discussed herein. In this embodiment, the backing member 100 includes helically shaped support members 102 that are formed integrally with the main body 104 substantially the entire distance from end to end of the backing member 100. Thus, instead of the support member or spring 24 being disposed on the outside and surrounding the outer periphery of the liquid absorbing member 22, the helical support members 102 in this embodiment are located inside the liquid absorbing member 22 and adjacent the body 104. The liquid absorbing material 22 may be applied to the outer surface 106 of the body 104 by conventional methods. It will be important for the liquid absorbing material 22 to be sufficiently affixed to the body 104 so as to prevent slippage therebetween.

Each helical member 102 has an outside diameter or length 108 that extends from the outer surface 106 of the body 104 a distance 110 that provides an offset area where aggregate 46 may collect and be re-deposited on the surface of the substrate 44. The distance 110 may be varied so as to accommodate various size aggregate 46. An integral aggregate dispersing applicator assembly 10 is thus provided which avoids the need for a separate spring or support member 24.

Figure 8:
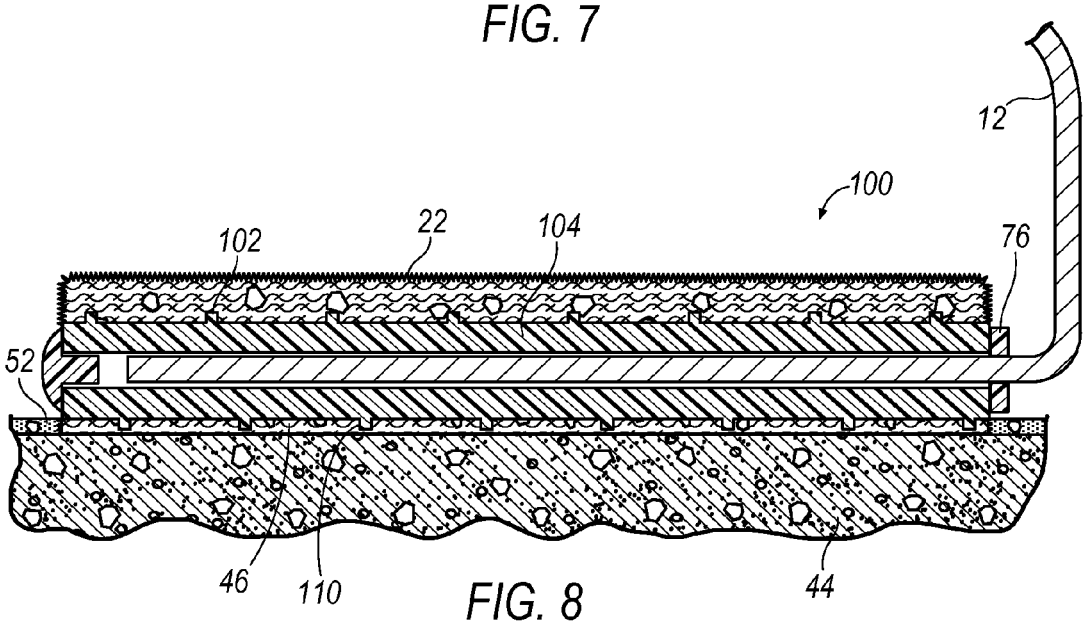
FIG. 8 is a cross-sectional view of the FIG. 7 backing member, with a liquid absorbing member installed.

FIG. 8 illustrates the backing member 100 with the liquid absorbing member 22 and they are collectively mounted to a handle 12. The paint roller assembly 10 is shown in the operational mode where a worker has depressed the handle 12 and is applying pressure on the assembly. The liquid absorbing member 22 is compressed but it is kept offset at least the predetermined distance 110 to allow aggregate 46 to pass there under and be affixed to the upper surface 52 of the floor 44 and thereby be evenly distributed. The cover 76 presses against the backing member 104 to prevent aggregate 46 from entering a cavity within the backing member 104.

Figure 9:
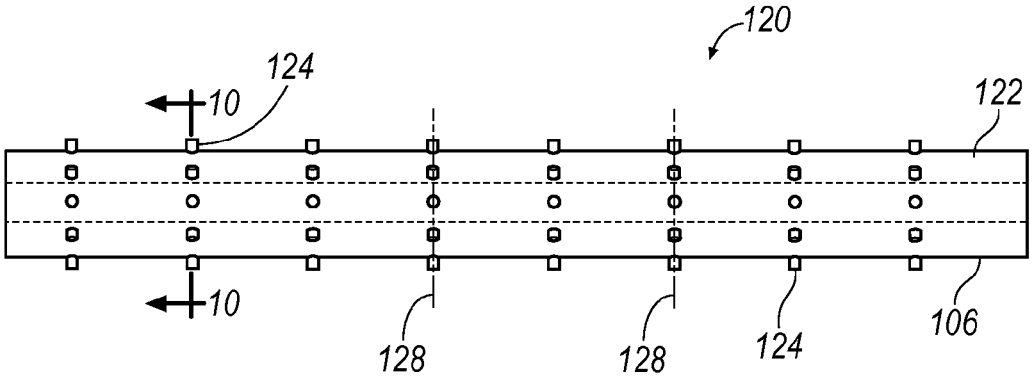
FIG. 9 illustrates another alternative backing member that may be used with the roller assembly that is shown in FIG. 1.
Figure 10:
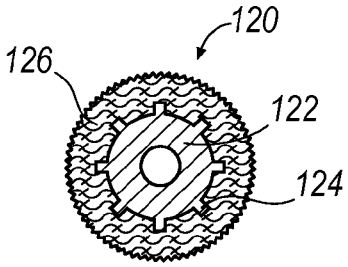
FIG. 10 is a cross-sectional view taken from section 10-10 of FIG. 9, illustrating a liquid absorbing member installed on the novel backing member.

FIG. 9 illustrates an alternate backing member 120 that includes a body 122 with a plurality of radially spaced individual support members 124. FIG. 10 illustrates a sectional view taken along line 10-10 of the FIG. 9 embodiment. A liquid absorbing material 126 is disposed around the outer periphery of the body 122 in the fashion similarly discussed in the FIG. 7 embodiment. However, the support members 124 are aligned vertically 128 in a plurality of single rows instead of in the helical fashion as depicted in the FIG. 6 embodiment. Thus, a plurality of rows 128 of vertically spaced support members 124 extend axially from an end to a distal end of the body 122. It will be appreciated that the number of rows 128 can be modified greater or lesser as may be desired or appropriate for a particular application or material. Each individual support member 124 may extend perpendicular or vertically from the outer surface 106.

Figure 11:
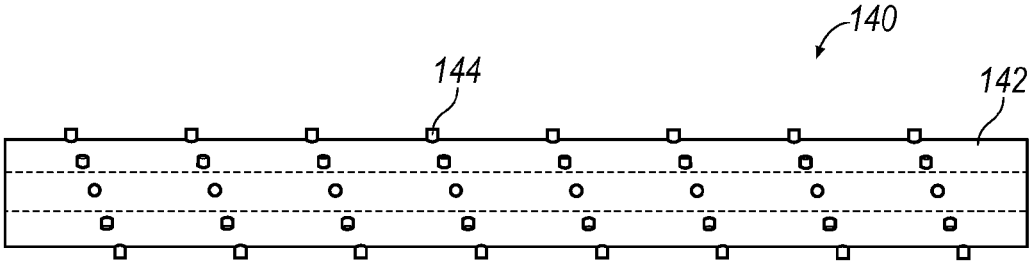
FIG. 11 illustrates another alternative backing member that may be used with the roller assembly that is shown in FIG. 1.

FIG. 11 illustrates a further alternate backing member 140 that includes a body 142 and a plurality of support members 144 that are spaced helically about the surface of the body 142. The individual support members 144 can include a variety of geometric configurations, for example they could be individual peg-like structures extending perpendicular from the surface of the body 142. The support members 144 are arranged in a helical fashion similar to the support members that are depicted in the FIG. 6 embodiment. Each support member 144 is spaced apart preferably an equal distance around the perimeter of the body 142 so as to provide a uniform support system that provides an offset for aggregate pieces 46 to be displaced evenly along a floor 44. The backing member 140 is operable to receive the liquid absorbing member 126 as is depicted in FIG. 10. Thus, FIG. 10 represents an end view of what the FIG. 11 embodiment would look like, once the nap or liquid absorbing member 126 has been applied thereto. The support members 144 act also to hold the liquid absorbing member 126 in place so as to minimize it from rotating relative to the body 142.

Figure 12:
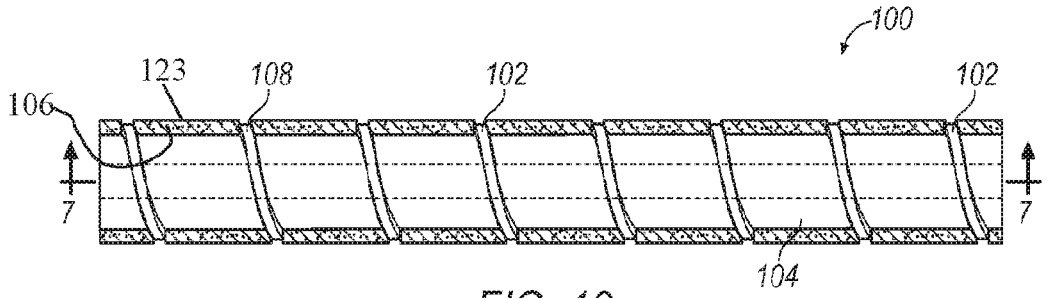
FIG. 12 illustrates an alternative embodiment that may be employed with the roller assembly that is shown in FIGS. 1 and 6.
Figure 13:
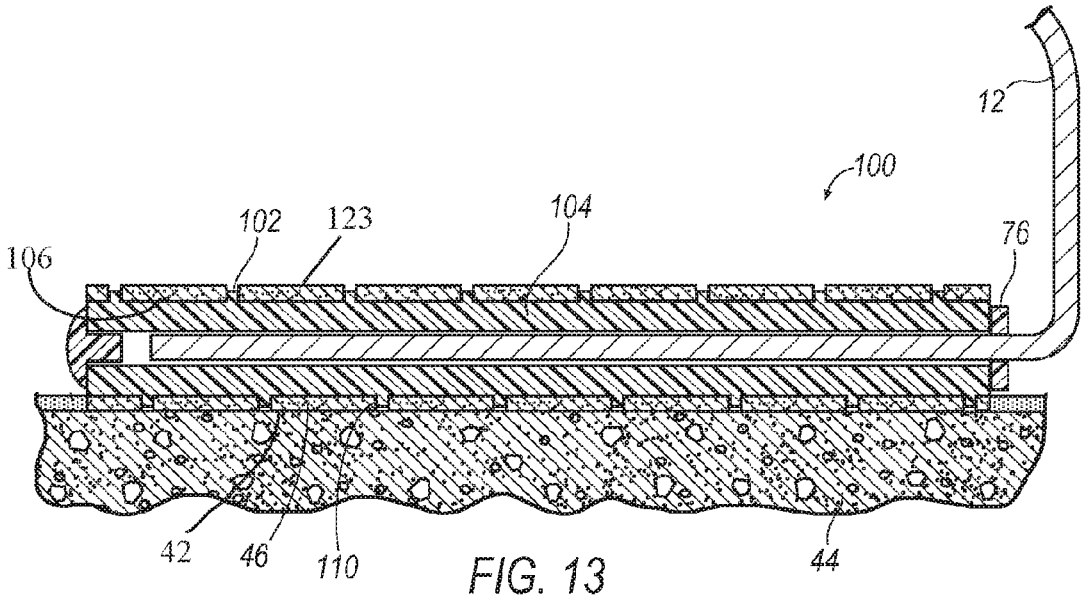
FIG. 13 is a partial cross-sectional view of the FIG. 12 alternate embodiment, with a liquid absorbing member installed.

FIGS. 12 and 13 illustrate a portion of an alternative exemplary embodiment of the roller assembly 10 according to the present disclosure including the improved backing member 100 as disclosed in FIG. 6 above. As shown in the exemplary embodiment of FIGS. 12 and 13, the backing member 100 may be utilized with a segmented liquid absorbing member 123 which functions similar to the liquid absorbing member 22 previously discussed herein. In this exemplary embodiment, the backing member 100 still includes helically shaped support members 102 that may be formed integrally with the main body 104 substantially the entire distance from end to end of the backing member 100. Each helical member 102 has an outside diameter length 108 that extends from the outer surface 106 of the body 104 a distance 110 that provides an offset area where aggregate 46 may collect and be re-deposited on the surface of the substrate 44. Thus, instead of the support member or spring 24 being disposed on the outside and surrounding the outer periphery of the liquid absorbing member 22, and instead of the helical support members 102 being located inside the liquid absorbing member 22 as in FIG. 6, the segmented liquid absorbing material 123 may be more selectively applied to the outer surface 106 of the body 104 so that the helical support members 102 may be generally exposed to the intended surface or substrate 44 while applying the coating 42 containing the aggregate 46. Similar to the above, the segmented liquid absorbing material 123 may be sufficiently affixed to the body 104 so as to prevent slippage there between.

In operation, the paint roller assembly 10 can use a novel applicator 16 that uses one of the backing members 20, 100, 120 or 140 as disclosed herein. During operation, a worker presses down on handle 12 and applies pressure on the applicator 16 which causes the applicator 16 to rotate. As it rotates a liquid coating 42 is disbursed onto a substrate 44. The applicator is raised off of the substrate 44 a distance preferably greater than the diameter of the aggregate 46 being applied to the substrate 44. Aggregate 46 are permitted to pass under the applicator 16 and adhere to the substrate 44. The coating 42 then cures with the aggregate 46 being located in a desirable fashion.

It will be appreciated that the aforementioned devices and method of operation may be modified to have some components or steps removed, or added, all of which are deemed to be within the spirit of the present invention. Even though the present invention has been described in detail with reference to specific embodiments, it will be appreciated that various modifications and changes can be made to these embodiments without departing from the scope of the present invention as set forth in the claims. Accordingly, the specification and the drawings are to be regarded as an illustrative thought instead of merely a restrictive thought of the scope of the present invention. It is intended that the scope of the present methods and apparatuses be defined by the following claims. It should be understood by those skilled in the art that various alternatives to the configurations described herein may be employed in practicing the claims without departing from the spirit and scope as defined in the following claims.

I claim:

1. An applicator for applying a coating material, the applicator comprising:

a backing member;

a liquid absorbing material located with respect to the backing member, the liquid absorbing material having a first side arranged adjacent the backing member and an opposite second side, the liquid absorbing material defining a channel extending from the first side to the second side; and a support member extending from the backing member in the channel and engaging the liquid absorbing material, at least a portion of the support member arranged with respect to the backing member and the second side of the liquid absorbing material.

2. The applicator of claim 1, wherein the support member is arranged below the backing member and at least a portion of the support member is displaced away from the backing member by the support member.

3. The applicator of claim 1, wherein the support member is arranged above the backing member and at least a portion of the support member is displaced toward the backing member by the support member.

4. The applicator of claim 1, wherein the support member is made of a material that prevents the support member from being compressed.

5. The applicator of claim 4, wherein the backing member is substantially impervious to the coating material.

6. The applicator of claim 1, wherein the backing member includes a generally cylindrical shape and includes an outer surface, the support member extending in a generally circular helix around the outer surface of the backing member.

7. The applicator of claim 1, wherein a distance between the first and second sides of the liquid absorbing material is greater than a thickness of the support member.

8. The applicator of claim 1, wherein the support member includes a raised projection extending outward from a surface of the backing member and adjoining the liquid absorbing material.

9. An applicator for applying a coating material, the applicator comprising:

a generally cylindrical backing member including an exterior surface;

a support member extending outward from the exterior surface of the backing member; and a liquid absorbing member attached to the exterior surface of the backing member and including an outer surface and defining a channel extending from the exterior surface of the backing member to the outer surface;

wherein the support member is in the channel.

10. The applicator as claimed in claim 9, further comprising a handle, the handle is connected to the backing member.

11. The applicator as claimed in claim 9, wherein the support member comprises a plurality of individual raised members extending outward from the backing member.

12. The applicator as claimed in claim 9, wherein the support member extends in a generally circular helix around an outer circumference of the backing member.

13. The applicator as claimed in claim 9, wherein the support member includes a first edge arranged adjacent the backing member and an opposite second edge displaced away from the backing member, the liquid absorbing member extending outward from the exterior surface of the backing member and beyond the second edge of the support member.

14. The applicator as claimed in claim 9, wherein the support member is a spring, the spring has an outside diameter substantially the same as an outside diameter of the liquid absorbing member.

* * * * *